US005850710A

United States Patent [19]

Brock

[11] Patent Number: 5,850,710

[45] Date of Patent: Dec. 22, 1998

[54] EMERGENCY ESCAPE WINDOW

[76] Inventor: Willie J. Brock, 2826 Connally Dr., Atlanta, Ga. 30311

[21] Appl. No.: 770,286

[22] Filed: Dec. 20, 1996

Related U.S. Application Data

[63] Continuation-in-part of Ser. No. 237,699, May 4, 1994, abandoned.

[51] Int. Cl.[6] ..... E05B 65/10

[52] U.S. Cl. ..... 49/141; 49/164; 49/400; 49/501

[58] Field of Search ..... 49/141, 181, 381, 49/400, 163, 164, 168, 501, 504

[56] References Cited

U.S. PATENT DOCUMENTS

| | | | |
|---|---|---|---|
| 1,819,696 | 8/1931 | Bohn | 49/400 X |
| 3,214,801 | 11/1965 | Nachtsheim | 49/164 |
| 3,442,049 | 5/1969 | Nachtsheim | 49/164 |
| 4,237,654 | 12/1980 | Landem et al. | 49/141 |
| 4,839,988 | 6/1989 | Betts et al. | 49/141 |
| 4,856,229 | 8/1989 | Tsemg | 49/56 |
| 4,897,961 | 2/1990 | Shine | 49/141 |
| 4,927,193 | 5/1990 | Miller | 292/92 |
| 5,042,852 | 8/1991 | Vitt et al. | 292/21 |
| 5,103,591 | 4/1992 | Szymanski | 49/379 |
| 5,289,655 | 3/1994 | Marmora et al. | 49/141 |

FOREIGN PATENT DOCUMENTS

| | | | |
|---|---|---|---|
| 634 | 1/1887 | United Kingdom | 49/164 |

*Primary Examiner*—Jerry Redman
*Attorney, Agent, or Firm*—John L. James

[57] ABSTRACT

An emergency escape window provides a large unobstructed opening for escape from a room during an emergency. The window unit includes a window frame for positioning in a window opening in a wall and fastening to the wall. The window unit has window lights contained in a jamb which fits inside the frame. A hinge is fastened to one frame member and the adjacent jamb member so that the jamb is pivotally movable relative to the frame between a closed position at which the jamb is flush with the frame and an open position at which the jamb is displaced from the frame. Vertical frame and jamb members opposite the hinge are tapered to prevent binding during opening and closing. A locking mechanism is attached to the jamb to lock the jamb and frame in the closed position. Operating the locking mechanism causes the jamb to swing away from the frame like a door to provide an opening for escape.

5 Claims, 3 Drawing Sheets

EMERGENCY ESCAPE WINDOW

CROSS REFERENCE TO RELATED APPLICATIONS

This application is a continuation-in-part of application Ser. No. 08/237,699 filed May 4, 1994, now abandoned.

TECHNICAL FIELD OF THE INVENTION

The present invention relates generally to windows, and, more particularly, to an emergency escape window used for exiting a building or dwelling during a fire or other emergency.

BACKGROUND OF THE INVENTION

Each year, thousands of people are injured or experience extreme anxiety because of fire and other building and dwelling emergencies. During a fire, the nearest exit is usually a window which is typically locked or blocked to deter criminal activity. Window locks are normally simple to operate, but during a fire, people panic and are often unable to perform the simple task of operating the lock to open the window to escape the fire. Bars and rods used to block a window so that the window does not open with the rod or bar in place. The bars and rods are normally very simple to remove by lifting them out of position, but during a fire panic sets in making their removal difficult.

The problem with window locks and blocks is that people do not use them enough for their operation to become second nature and therefore available during a panic situation. Also, a child may have never unlocked a window and cannot realistically be expected to do so during a fire. To most people, operating a door is a natural and almost unconscious action and most could and would use the pushing and turning motion during a fire. It is therefore desirable to have a window lock that operates using motions that would be natural to a person trying to escape during a fire.

Dwellings typically have bedroom windows that open for ventilation. Even when a house is air conditioned, the windows are often opened slightly to allow fresh air to enter. Because windows are opened and closed often, there is a danger that emergency escape windows will be left unlocked allowing children or unknowing adults to inadvertently operate the window and fall to the ground. Another problem with emergency escape windows is providing a weather tight unit that is easy to operate. Accordingly, it will be appreciated that it would be highly desirable to have an emergency escape window that is weather tight and whose emergency lock does not interfere with normal operation of the window.

SUMMARY OF THE INVENTION

The present invention is directed to overcoming one or more of the problems set forth above. Briefly summarized, according to one aspect of the present invention, a window unit for a wall containing a window opening comprises a window frame for positioning in the opening and fastening to the wall, a window unit for positioning in the window frame, a hinge fastened to a front side portion of a second frame member and a front side portion of a second jamb member, and a locking mechanism attached to the jamb to lock the jamb and frame in a closed position.

The window frame has a first vertically extending member with top and bottom end portions and front and rear side portions, a second vertically extending member spaced from the first frame member with top and bottom end portions and front and rear side portions, and a horizontally extending frame member attached to the top portions of the first and second frame members.

The window unit has window lights contained in a jamb. The jamb has a first vertical jamb member with front and rear side portions positioned adjacent the first frame member and has a second vertical jamb member with front and rear side portions positioned adjacent the second frame member. A hinge is fastened to the front side portion of the second frame member and to the front side portion of the second jamb member so that the jamb is pivotally movable relative to the frame between a closed position at which the jamb is flush with the frame and an open position at which the jamb is displaced from the frame. The locking mechanism is attached to the jamb to lock the jamb and frame in the closed position.

The window lights provide light to enter a room and the windows operate in normal fashion to allow fresh air to enter. In an emergency, pushing on the locking mechanism causes the mechanism to release and causes the jamb to swing away from the frame so that the window opens like a door providing a large unobstructed opening for escape.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE PREFERRED EMBODIMENTS

Figure 2:
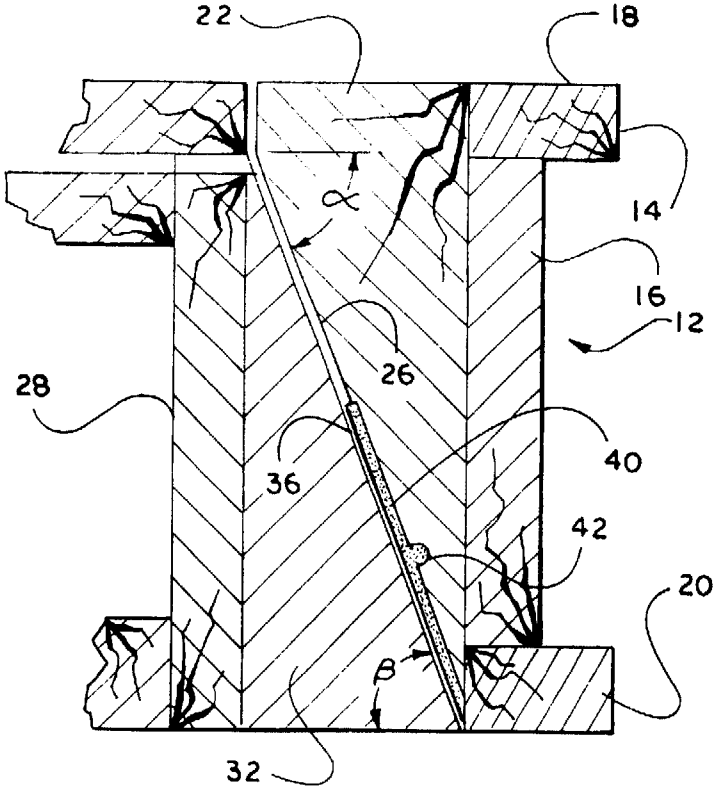
FIG. 2 is a diagrammatic sectional view taken along line 2—2 of FIG. 1 with the window closed.
Figure 1:
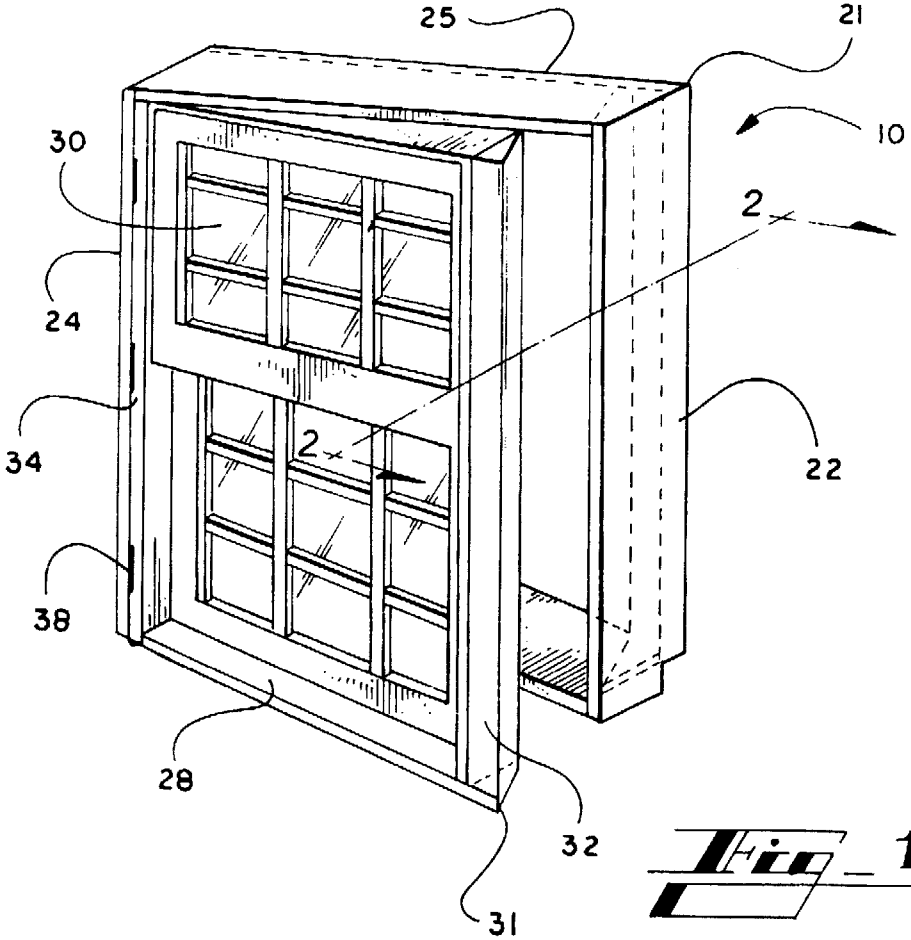
FIG. 1 is a perspective front view of a preferred embodiment of an emergency escape window according to the present invention.
Figure 3:
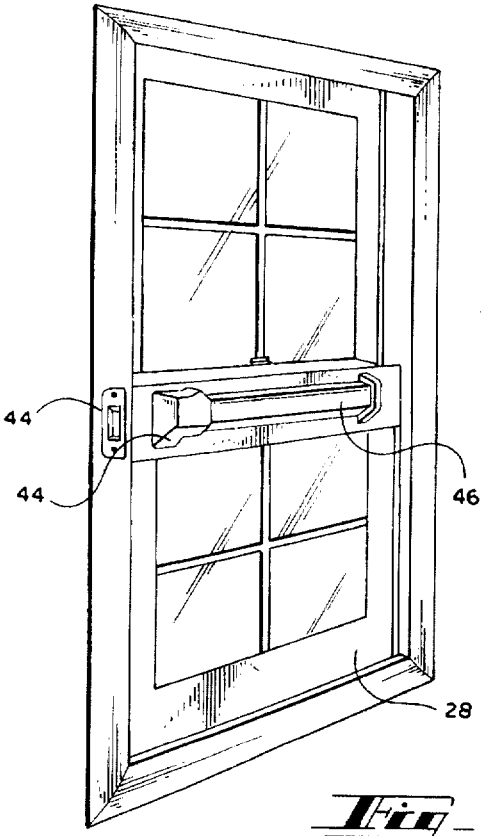
FIG. 3 is a diagrammatic rear view of the window of FIG. 1.

Referring to FIGS. 1–3, a window assembly 10 is sized to fit a window opening 12 in a wall 14 of a dwelling or other building structure. The wall 14 contains wall studs 16 to which wallboard 18 or other interior sheathing is attached on one side, and on the opposite side of the studs, siding 20 or other exterior sheathing is attached to form the interior and exterior walls of the building.

A window frame 21 is positioned in the wall opening 14 and is fastened to the wall studs 16 by nails, screws or the like. The window frame 21 has a right vertically extending frame member 22 with top and bottom end portions and front and rear side portions. The front portion of the right frame member 22 is adjacent the exterior siding 20 while the rear portion of the right frame member 22 is adjacent the interior wallboard 18. A left vertically extending frame member 24 is spaced from the right frame member 22. The left frame member 24 also has top and bottom end portions, a front side portion adjacent the exterior siding 20, and a rear side portion adjacent the interior wallboard 18. A top frame member 26 extends horizontally and is attached to the top end portions of the left and right frame members 24, 22. Top frame member 26 forms a horizontal header on the top ends of the vertical frame members. Window trim and an apron are attached to the frame inside the building to cover the joint between the frame and interior wallboard 18 as is known in the art.

The exterior front side portion of the right vertical frame member 22 is narrower than the interior rear side portion of the right frame member creating a tapered or angled mating face 26. Mating face 26 angles inward from a read edge of the right frame member at an angle α which lies in a range from about 82 degrees to about 70 degrees. The angle α is measured between the rear edge and mating face 26 so that its complementary angle at the front side of the frame is in the range of about 8 degrees to about 20 degrees with 14 degrees being optimum. This gives the right frame member 22 a generally triangular cross-section. For aesthetic appeal, there may be a small portion adjacent the rear edge of right frame member 22 where the face 26 is straight instead of angled.

A window unit 28 is positioned in the window frame 21. The window unit has window lights 30 contained in a jamb 31 that includes a right vertically extending jamb member 32 with front and rear side portions, and a left jamb member 34 with front and rear side portions. The right jamb member 32 is positioned adjacent the right frame member 22, and the left jamb member 34 is positioned adjacent the left frame member 24.

The front side portion of the right jamb member 32 is wider than the rear side portion of the right jamb member creating a tapered or angled mating face 36. Mating face 36 of the jamb angles inward from a front edge of the right jamb member 34 at an angle β which lies in a range from about 82 degrees to about 70 degrees. The angle β is measured between the front edge of the right jamb member 32 and mating face 36 so that its complementary angle at the rear side of the jamb is in the range of about 8 degrees to about 20 degrees with 14 degrees being optimum. Preferably, the angles α and β are 76 degrees. At angles greater than about 82 degrees, the mating surfaces 26, 36 abut one another causing the jamb, and window lights inside it, to protrude forward from the frame. At angles less than about 70 degrees, the jamb protrudes rearward from the frame into the room. Angle α and the complement of angle β are complementary, and angle β the complement of angle α are complementary.

Figure 6:
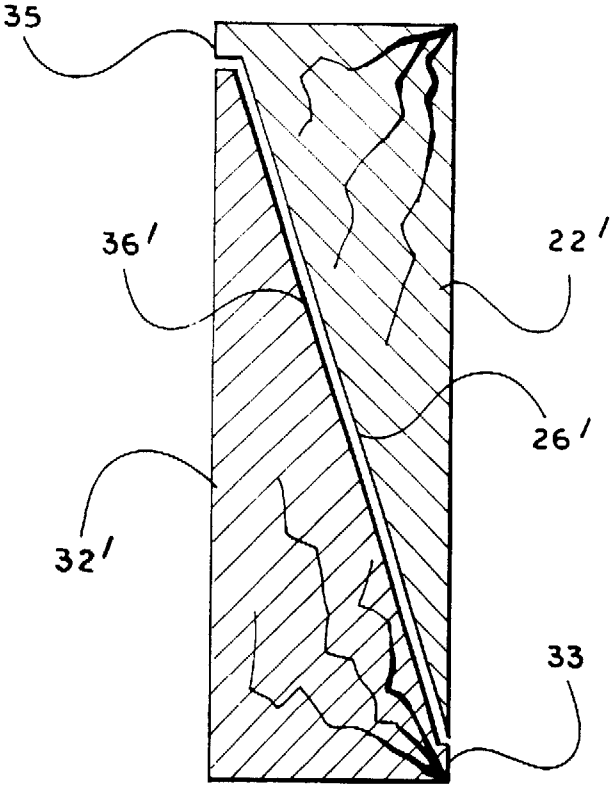
FIG. 6 is a sectional view similar to FIGS. 2, 4 and 5 but illustrating another preferred embodiment.

Referring to FIG. 6, for aesthetic appeal, there may be a small portion 33 adjacent the front edge of the right jamb member 32' where the face 36' is straight instead of angled. Similarly, there may be a small portion 35 adjacent the rear edge of the right frame member 22' where the face 26' is straight instead of angled. Additionally, the straight face portions 33, 35 help form a weather seal.

A hinge 38 is fastened to the front side portion of the left frame member 24 and also to the front side portion of the left jamb member 34. Hinge 38 allows the jamb 31 to pivotally move relative to the frame between a closed position at which the jamb is flush with the frame, and an open position at which the jamb is displaced from the frame. At the open position, the jamb is displaced forward from the frame so that the jamb is outside the room. The hinge may be of any variety but it is preferred that the hinge be a piano hinge or a spring loaded hinge. A piano hinge is preferred because it is more easily concealed, and because of its long length, is extremely strong. Also, a piano hinge can be attached with short screws allowing thinner jamb and frame members to be sued. A spring loaded hinge would bias the jamb toward the open position making escape easier in an emergency. The spring bias may be selected to be great enough to overcome paint or ice build-up that may be present on the frame and jamb causing them to stick together.

Figure 5:
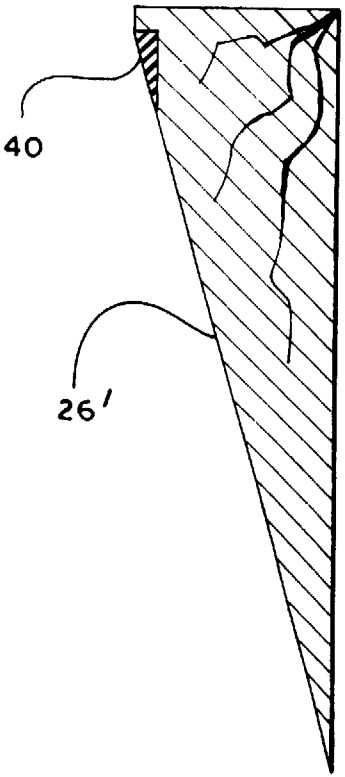
FIG. 5 is a sectional view similar to FIGS. 2 and but illustrating another preferred embodiment.

A piece of weather stripping 40 is preferably attached to the mating face 26 of the frame with nails, adhesives or the like, or may be fitted into a groove 42 in the right frame member 24. Weather stripping 40 may extend the entire width of the mating face 26 or may extend over any portion of the mating face 26 as desired (See FIG. 5). Extending the weather stripping 42 partially over either of the mating faces 26, 36 is sufficient to prevent air infiltration. Weather stripping may be also applied to the top frame or jamb, left frame or jamb, and to the bottom of the frame or jamb as well to form an air seal, but it is not necessary any more so than with any other window because the details of construction conventionally block direct air flow paths. However, along the mating surfaces 26, 36, there may be a direct path for air infiltration. Where construction tolerances are very closely observed, weather stripping may be eliminated, but it is preferred to include resilient weather stripping to compensate for variances in humidity that affect wooden jambs and frames and for expansion and contraction where metal is used instead of wood.

A locking mechanism 44 is attached to the window jamb to lock the jamb and frame in the closed position. The locking mechanism 44 preferably includes a push-bar 46 exit device extending horizontally between the left and right jamb members 34, 32 that is operable by pushing to unlock the frame and jamb so that the jamb may be pushed outward from inside the room opening the window which swings on the hinge 38 like a door. When the window is opened, the frame provides an unobstructed opening for exit the room because the window is pushed away and pivots on the hinge 90 degrees or more which is sufficient for unobstructed exiting in an emergency.

Figure 4:
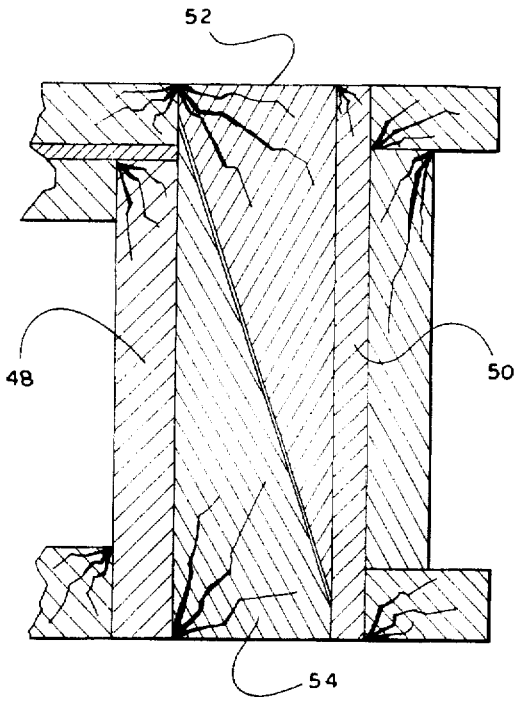
FIG. 4 is a sectional view similar to FIG. 2 but illustrating another preferred embodiment.

FIG. 4 illustrates right vertical jamb and frame members 48, 50 with laminations or wedges 52, 54 interposed between them. The jam wedge 52 is similar to right frame member 22, and jamb wedge 54 is similar to right jamb member 24 (FIG. 2). The difference is that members 22, 24 each achieve triangular cross-sectional configuration with a single piece of material while two pieces of material are required for the wedges. A single piece of material is preferred for new construction where both the frame and jamb are precision constructed in a factory. Where an existing window is converted, multiple pieces are advantageous because existing materials can be used thereby conserving resources. To convert an existing window, the jamb is removed from the opening. If there is no window frame, then a frame is constructed for the opening. If a frame has to be constructed, then a frame wedge is not required because a single triangular piece can be used, but a frame wedge may be used. If a frame exists, then a frame wedges installed. The right jamb member 50 is trimmed reducing its thickness to compensate for the thickness of the wedges, and the jamb wedge is installed. The jamb member 50 could be trimmed to achieve the triangular configuration, but a wedge can be simply installed with dowels, adhesive, nails or screws. For a wall with nominal 4 inch wall studs, the jamb member 50 is about 5 inches from front to rear. At the preferred mating face angle of 76 degrees, the jamb wedge has a thickness of about 1¼ inches. Thus only about 1¼ inches of material have to be removed which can be removed symmetrically retaining the aesthetic appeal of the window.

Operation of the present invention is believed to be apparent from the foregoing description, but a few words will be added for emphasis. In an emergency, a person moves to the window and pushes. The push-bar spans the window and is easy to find without looking. Pushing the push-bar unlocks the window and its jamb from the frame causing the window and jamb to pivot on the hinge outward in the direction of the pushing force applied. The persons then exits through the opening defined by the frame. Because the window and jamb are pushed out of the way, the large frame opening provides an unobstructed exit.

It can now be appreciated that an emergency escape window has been presented. The window unit can be assembled in a factory and shipped to a construction site ready to be installed, or an existing window can be retrofitted using wedges. The window unit includes a window frame for positioning in a window opening in a wall and fastening to the wall. The window unit has window lights contained in a jamb which fits inside the frame. A hinge is fastened to one frame member and the adjacent jamb member so that the jamb is pivotally movable relative to the frame between a closed position at which the jamb is flush with the frame and an open position at which the jamb is displaced from the frame. A locking mechanism is attached to the jamb to lock the jamb and frame in the closed position. Operating the push-bar of the locking mechanism causes the jamb to swing away from the frame like a door to provide an opening for escape. The push-bar responds to panic motion to unlock the unit. Because most people, including children, are accustomed to pushing on a door, they can operate the emergency escape window. The window lights operate in normal fashion to provide light and ventilation. Normal window operation does not activate the push-bar lock so there is no danger of falling through the frame opening because the window was opened for ventilation.

It can also be appreciated that a method for converting a window unit for a wall containing an opening to an emergency escape window has been presented. The method includes removing the existing window unit from the wall opening. The window unit is contained in a window jamb which is removed with the double hung or casement windows as a unit. The window jamb typically has a first vertical jamb member with front and rear side portions positionable adjacent the first frame member, and has a second vertical jamb member with front and rear side portions positionable adjacent the second frame member. The method includes forming a wedge on the first vertical jamb member making the front side portion of the first vertical jamb member wider than the rear side portion of the first vertical jamb member creating a tapered mating face that angles inward from a front edge of the first vertical jamb member. Preferably, the wedges are applied with dowels, however, it is possible to modify the jamb by removing material to give it a triangular or wedge configuration instead of using a wedge or lamination.

The method continues with constructing a window frame for positioning in the opening and fastening to the wall. The window frame has a first vertically extending member with top and bottom end portions and front and rear side portions. The front side portion of the first vertical frame member is narrower than the rear side portion of the first vertical frame member creating a tapered mating face that angles inward from a rear edge of the first vertical frame member. A second vertically extending frame member is spaced from the first frame member and has top and bottom end portions and front and rear side portions. A horizontally extending frame member is attached to the top portions of the first and second frame members.

The method requires mounting the window unit in the frame, and fastening a hinge to the front side portion of the first frame member and the front side portion of the first jamb member. When mounted, the jamb is pivotally movable relative to the frame between a closed position at which the jamb is flush with the frame and an open position at which the jamb is displaced from the frame. At the closed position, the mating faces are adjacent one another.

Finally, the frame is mounted in the wall opening. Before mounting, it may be necessary to enlarge the opening to accommodate the frame which slightly increases the height and width of the opening required compared with the window that was removed. To retain symmetry, the thickness of the hinge side of the frame can be increase to equal that of the wedge side of the frame. When molding is replaced the modification is not noticeable to the property owner. When the opening is enlarged, it can be enlarged symmetrically to retain aesthetic appeal.

As is evident from the foregoing description, certain aspects of the invention are not limited to the particular details of the examples illustrated. For example, the frame and jamb members have been described as being formed of wood, but metal, plastic or composite material may be used. While the invention has been described with reference to the preferred embodiments, other modifications and applications will occur to those skilled the art. For example, while the weather stripping has been described as an elastomeric material, resilient metal can be used. It is accordingly intended that the claims shall cover all such modifications and applications as do not depart from the true spirit and scope of the invention.

What is claimed is:

1. A window for a wall containing an opening, comprising:

a window frame, for positioning in said opening and fastening to said wall, having a first vertically extending frame member with top and bottom end portions and front and rear side portions, said front side portion of said first vertical frame member being narrower than said rear side portion of said first vertical frame member creating a tapered mating face that angles inward from a rear edge of said first vertical frame member, and having a second vertically extending frame member spaced from said first vertical frame member with top and bottom end portions and front and rear side portions, and a horizontally extending frame member attached to said top portions of said first and second vertical frame members;

a window jamb, for positioning in said window frame, having a first vertical jamb member with front and rear side portions positioned adjacent said first vertical frame member, and having a second vertical jamb member with front and rear side portions positioned adjacent said second vertical frame member, said front side portion of said first vertical jamb member being wider than said rear side portion of said first vertical jamb member creating a mating face, said mating face having a tapered central portion that angles inward from a front edge of said first vertical jamb member and having a straight end portion adjacent said tapered central portion; and a hinge fastened to said front side portion of said second vertical frame member and said front side portion of said second vertical jamb member, said jamb being pivotally movable relative to said frame between a closed position at which said jamb is flush with said frame and an open position at which said jamb is displaced from said frame, said tapered mating faces being adjacent one another when said jamb and frame are in the closed position.

2. A window, as set forth in claim 1, wherein said tapered mating face of said jamb tapers inward from a front edge of said first vertical jamb member at an angle of about 76 degrees, and said tapered mating face of said frame tapers inward from a rear edge of said first vertical frame member at an angle of about 76 degrees.

3. A window, as set forth in claim 1, wherein one of said mating faces of one of said frame and jamb define a groove and including a weather strip fitted in said groove and attached to said mating face of one of said frame and jamb.

4. A window, as set forth in claim 1, wherein said tapered mating face of said jamb tapers inward from a front edge of said first vertical jamb member at an angle in a range from about 70 degrees to about 82 degrees, and said tapered mating face of said frame tapers inward from a rear edge of said first vertical frame member at an angle in a range from about 70 degrees to about 82 degrees.

5. A window, as set forth in claim 1 including a locking mechanism attached to said jamb to lock said jamb and frame in said closed position, said locking mechanism having a push-bar exit device extending horizontally between said first and second vertical jamb members operable by pushing to unlock said frame and jamb to thereby provide an escape route through said wall.

* * * * *